US006205585B1

(12) United States Patent
Capparelli

(10) Patent No.: US 6,205,585 B1
(45) **Date of Patent: *Mar. 27, 2001**

(54) ADJUSTABLE GARMENT

(75) Inventor: Karen Capparelli, Brooklyn, NY (US)

(73) Assignee: Cee Caryn Designs Ltd., Brooklyn, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/007,680

(22) Filed: Jan. 15, 1998

(51) Int. Cl.[7] ..... A41D 1/18; A41C 3/08

(52) U.S. Cl. ..... 2/106; 2/109; 450/32; 450/33

(58) Field of Search ..... 2/49.1, 52, 46, 2/104, 106, 107, 109, 110, 103, 92, 73, 74, 48, 69, 105, 113, 300, 301, 311, 323, 67, 207; 450/31, 32, 33, 34, 35

(56) References Cited

U.S. PATENT DOCUMENTS

| | | | | |
|---|---|---|---|---|
| D. 234,985 | | 4/1975 | Kreisel | D2/226 |
| 564,925 | | 7/1896 | Grafftey . | |
| 933,265 | * | 9/1909 | Reid | 2/110 |
| 939,712 | * | 11/1909 | Kleinert | 2/46 |
| 1,067,761 | * | 7/1913 | Schulz | 2/46 |
| 1,259,046 | | 3/1918 | Reber . | |
| 1,317,621 | * | 9/1919 | Donaldson | 2/110 |
| 1,406,225 | * | 2/1922 | Rathsmill | 2/46 |
| 1,632,137 | * | 6/1927 | Jackson | 450/32 |
| 1,927,018 | * | 9/1933 | Bloom | 450/32 |
| 1,990,322 | | 2/1935 | Goldberg | 2/73 |
| 2,268,781 | * | 1/1942 | Slotoroff | 450/32 |
| 2,359,804 | * | 10/1944 | Struthers | 450/32 |
| 2,376,969 | | 5/1945 | Katzman . | |
| 2,493,179 | * | 1/1950 | Wittenberg | 2/110 |
| 2,531,994 | | 11/1950 | Stain | 2/73 |
| 2,595,139 | | 4/1952 | Hart . | |
| 2,869,552 | * | 1/1959 | Smith | 450/32 |
| 2,879,515 | * | 3/1959 | Franklin | 2/110 |
| 2,880,731 | | 4/1959 | Kendall | 128/454 |
| 3,098,485 | * | 7/1963 | Howell | 450/31 |
| 3,212,503 | | 10/1965 | Gorman . | |
| 3,297,035 | * | 1/1967 | Wright | 450/32 |
| 4,798,557 | | 1/1989 | Scott . | |
| 5,045,018 | | 9/1991 | Costanzo . | |
| 5,171,182 | | 12/1992 | Heinen . | |

FOREIGN PATENT DOCUMENTS

| | | | | |
|---|---|---|---|---|
| 411587 | * | 3/1925 | (DE) | 450/32 |
| 818997 | * | 8/1959 | (GB) | 2/52 |
| 87/06105 | * | 10/1987 | (WO) | 2/49.4 |

* cited by examiner

*Primary Examiner*—Amy B. Vanatta

(57) ABSTRACT

A garment that replaces a full shirt or blouse which is comprised of a frontal portion piece of material that attaches to an undergarment by the engagement of male and female snaps around the undergarment. The garment is fastened around the torso of the wearer by means of an elastic band with a hook which engages an elastic loop. Three female snaps are provided in order to adjust the drape of the neckline of the garment. An optional scarf may be attached to the garment in order to create a matching ensemble.

13 Claims, 5 Drawing Sheets

ADJUSTABLE GARMENT

FIELD OF THE INVENTION

This invention relates to an improvement in garments, particularly shirts and blouses.

BACKGROUND OF THE INVENTION

Most conventional shirts and blouses tend to be restrictive as they are composed of a back portion and a front portion and sleeves joined together at seams. In some cases, shirts and blouses are made without sleeves. However, in either case, movement tends to be restricted in the arm and shoulder areas of the garment as well as the area between the shoulder blades. This restriction can be uncomfortable for certain individuals, such as the weight challenged, handicapped, or elderly. One of the benefits of the present invention is that it does not restrict movements, such as bending, especially for weight challenged people. It is also much neater looking in appearance.

Another benefit of this invention is that it provides better ventilation and is cooler than a full shirt or blouse since it is comprised only of a frontal piece of fabric. Because there are no sleeves or armholes, there is no perspiration to affect the material of the garment, since air is always circulating.

Handicapped or physically challenged people who may find it difficult to put on a full shirt or blouse will find it easy to just put this garment on. This includes arthritic, convalescing or elderly individuals. Women who are going through menopause often get periods of perspiration and hot flashes and find that clothing can be an overwhelming discomfort at this time. This garment will greatly reduce the discomfort and restricted feeling of a full blouse, yet provide the advantage of the appearance of a full blouse.

SUMMARY AND OBJECTS OF THE INVENTION

The object of this invention is to give the appearance of a full blouse without all the restrictions of a regular blouse. There are multiple useful functions for this garment. This garment can serve as a blouse and scarf ensemble to be worn under a suit jacket or as a blouse alone. The suit jacket may be worn buttoned or unbuttoned. There is also the option of detaching the scarf and wearing it elsewhere, such as around the waist as a belt, to create a matched ensemble. The blouse can be tucked into or worn outside of a pair of pants or a skirt.

It is another object of this invention to provide an appearance of a full blouse or garment which is simple in construction, easy to manufacture at reduced cost and which is adapted to fit wearers with various sized waistlines and bustlines, without need for alteration of the seams and without the need for any other changes to obtain proper fitting. According to this invention, each size of the product will cover a varied scope of bust and waist sizes.

Another advantage is that by insertion of the elastic band through the channel at the base of the blouse, rather than attaching it to the edge of the fabric, causes less stress on the fabric of the blouse; the blouse is better constructed to last longer.

Still a further object of this invention is to provide the same appearance of a conventional full blouse. Because of its compact size, a woman can wear a conservative version of this garment to work and then easily change into a dressy version for evening wear. A woman can wear a version that is suitable for business wear to work, and carry a formal version in its tiny purse-sized pouch to change into for formal evening wear.

Another object of this invention is to provide a garment that is lightweight and space saving. Because of its compact size, this garment will fit easily into any piece of luggage. This is beneficial for people who must travel frequently.

The mini version of this garment can be worn under a open front blouse or jacket by any female with or without the scarf attachment. This version is also beneficial for pregnant women, since it causes no stress or restriction on the abdominal area.

The tie version of the blouse is designed for wearing without an undergarment, particularly for individuals that are convalescing at home, in a nursing home or in a hospital. This version can be made of paper. The paper can be adorned with a design. The benefit of this version is that it is disposable, recyclable, and bio-degradable. This version may be worn under a bed jacket or robe. A person can wear this blouse and be comfortable, yet the doctor and health care professionals would have easy access for examination purposes. This garment allows the wearer to look nice, to meet and greet visitors, thereby uplifting their spirits during possible post operative depression.

All versions of this garment have the capability of partial self styling by permitting the wearer to make the adjustment for the desired degree of frontal exposure of cleavage. The male snap portion on the top edge of the blouse merely wraps around the shoulder strap of the bra, slip, camisole, or any undergarment with shoulder straps, and snaps into any of the three female portions of the snap on the top edge of the blouse according to the amount of drape desired. The scarf can also be worn however the individual decides to drape it. The scarf may be completely detached from the garment, if desired.

The cleaning and care of this garment is easy and inexpensive. The blouse may simply be dipped in cool water and mild soap and hung to dry. There is no ironing or dry cleaning necessary, which saves time and money. The nature of this invention tremendously facilitates easy maintenance and cleaning for the wearer, or in some instances, a care giver. The absence of sleeves, pleats, and even sleeve holes provides a garment which is simply washed. The simplicity of cleaning this garment is another benefit for the physically challenged and all men and women in this busy world we live in. The cost is less than if a separate blouse and a scarf were purchased.

It should also be understood that this invention can be used by men. The garment can be attached to a sleeveless undershirt or tank top.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
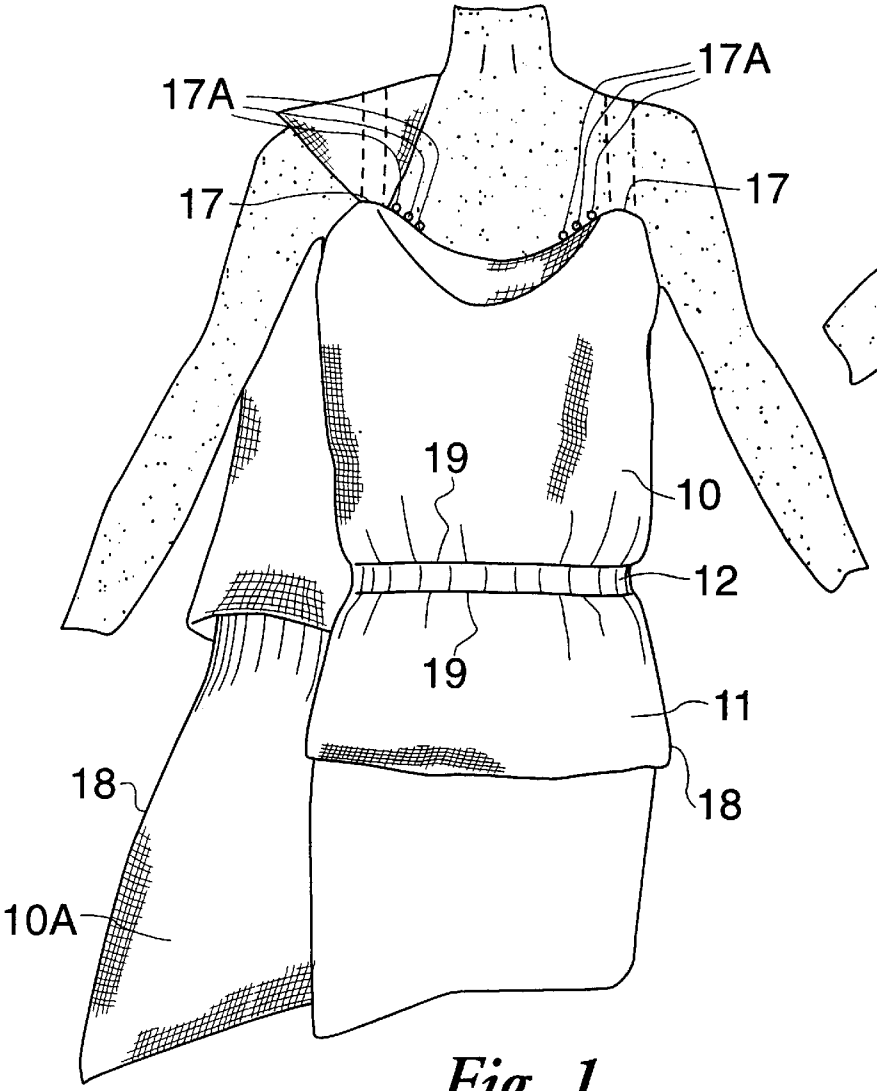
FIG. 1 is a front view of the garment of the present invention with the neckline draped, the optional scarf attached, and worn by a person.
Figure 3:
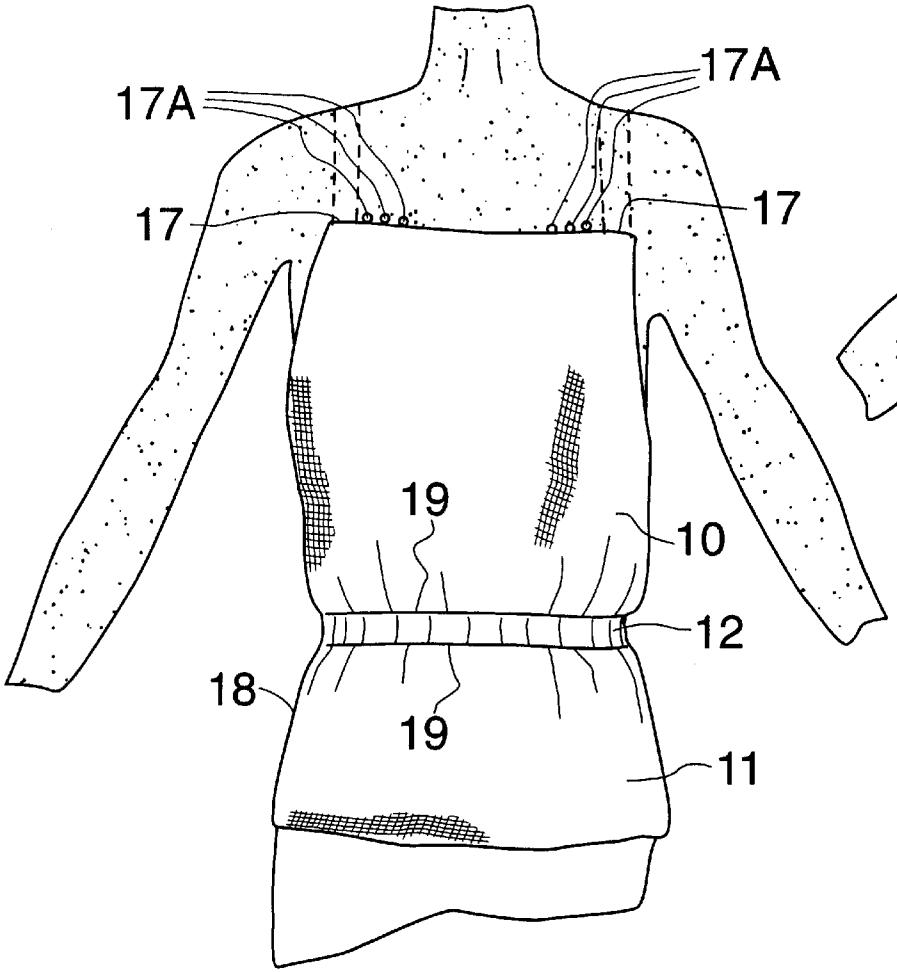
FIG. 3 is a front view of the garment of the present invention with the neckline taut, the optional scarf detached, and worn by a person.
Figure 5:
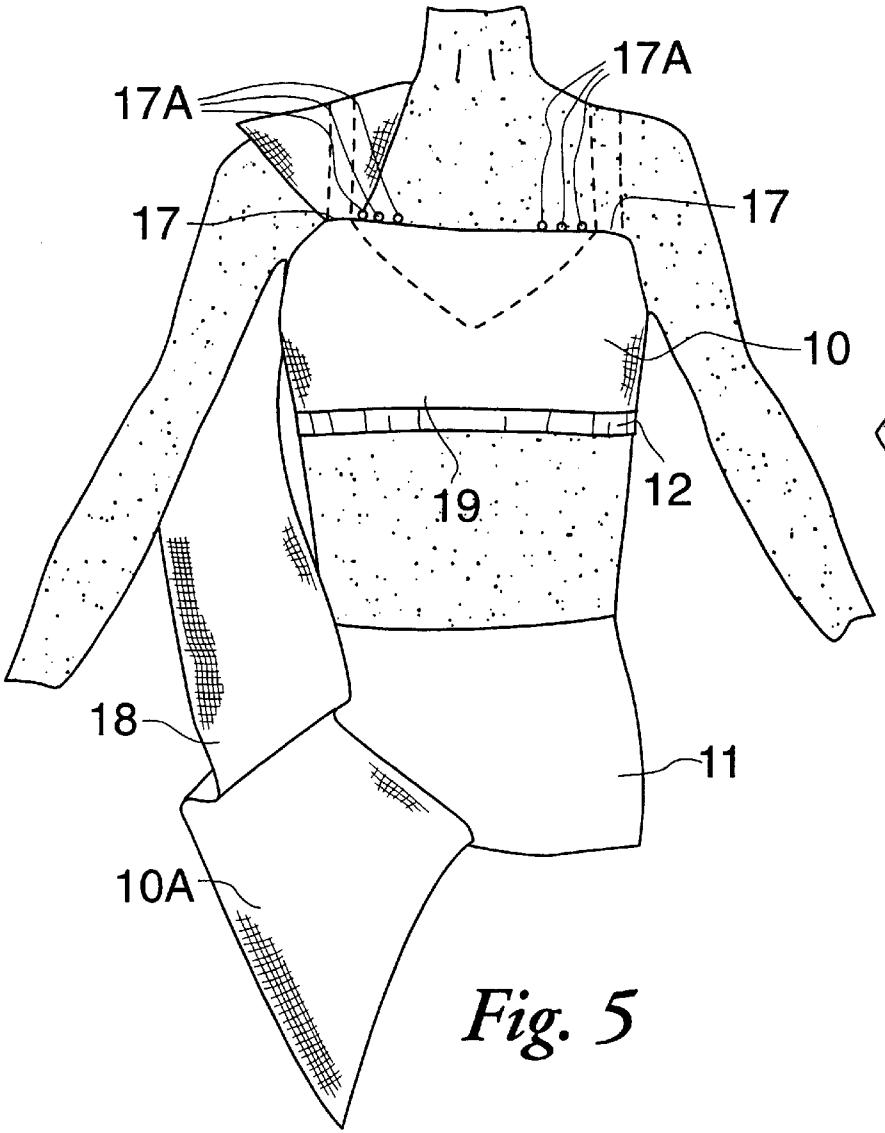
FIG. 5 is a front view of an alternative embodiment of the garment with the optional scarf attached, and worn by a person.
Figure 7:
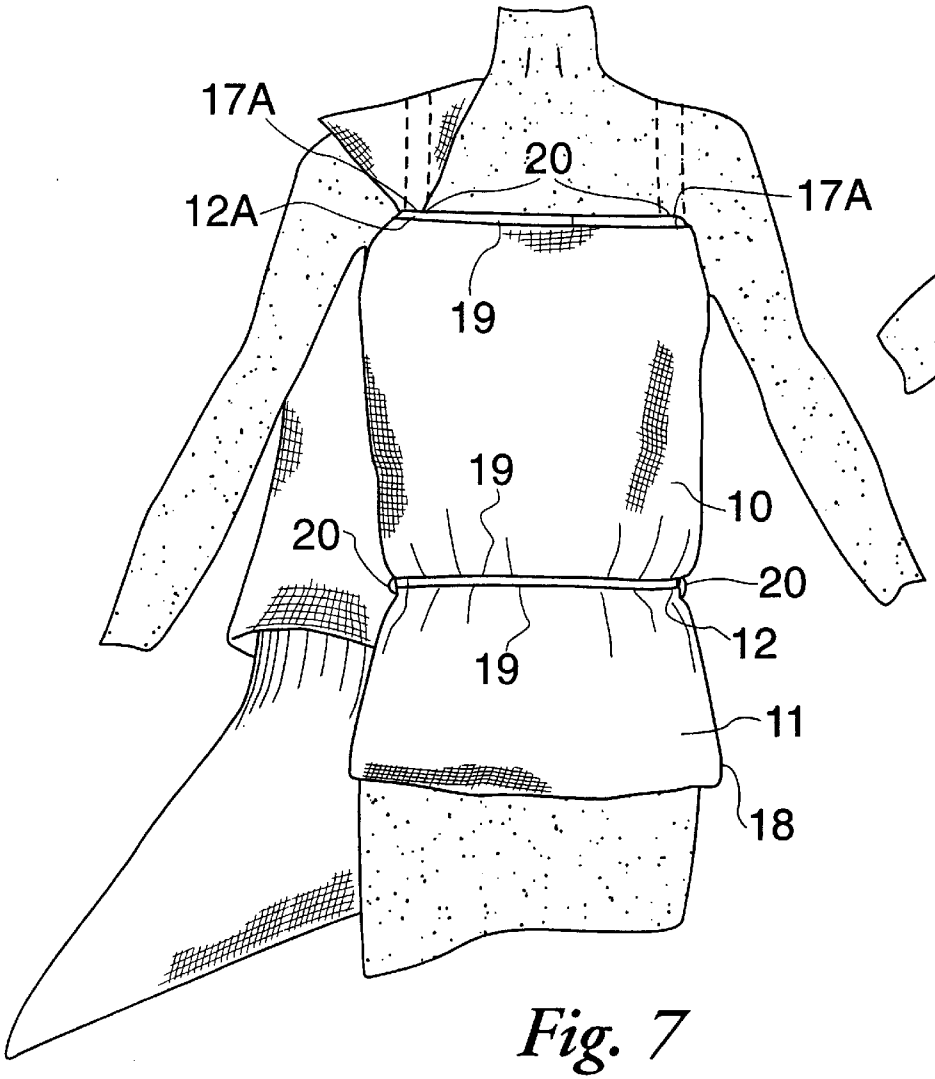
FIG. 7 is a front view of another alternative embodiment of the garment with the optional scarf attached, and worn by a person.

Referring to the drawings, and in particular to FIGS. 1,3,5 and 7, an upper frontal fabric portion 10 contains a ¾ inch channel 12 through the bottom edge of the upper frontal fabric portion 10. The channel 12 is created with thread 19 and also serves to connect the upper frontal fabric portion 10 with a lower frontal fabric portion 11. In FIGS. 1,3 and 7, the lower frontal fabric portion 11 is also known as a peplum. Three female snaps 17*a* are placed on both sides of the top of the upper frontal fabric portion 10 as shown in FIGS. 1,3 and 5 to adjust the amount of cleavage drape. The female snaps 17*a* are attached to the top of the frontal portion piece 10 by thread. As illustrated in FIG. 1, one of the female snaps 17*a* is used for attachment of an optional scarf 10*a*. The scarf 10*a* and frontal portion piece 10 form are two separate elements, which when assembled, give the appearance of a single integral article of clothing. In FIGS. 1,3,5 and 7, a male snap portion 17 wraps around the backside of the bra strap to the front of the bra strap and snaps into any one of the female snaps 17*a*, according to the amount of drape desired. In FIGS. 1,3 and 5, the two male snap portions 17 are located separately on the upper left and right hand corner edge of the upper frontal portion of the garment and are attached to the garment by thread.

In FIGS. 1,3,5 and 7, the amount of material will be doubled when the garment is made of shear fabric. If the garment is made of a heavier fabric, it will be cut on the bias for proper drape and the neckline of the upper frontal portion piece 10 will be hemmed down approximately two inches with thread 19, so that when draped the back side of garment will show the same fabric as the front side of the garment.

Figure 2:
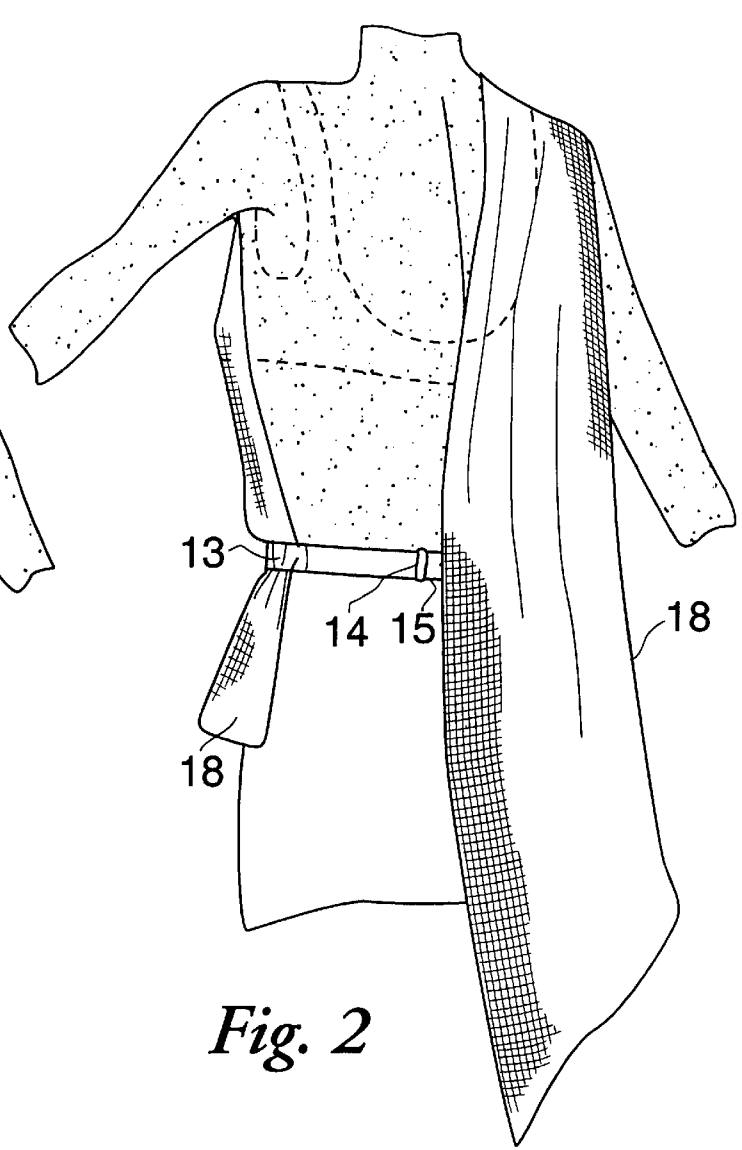
FIG. 2 is a rear view of the garment shown in FIG. 1.
Figure 4:
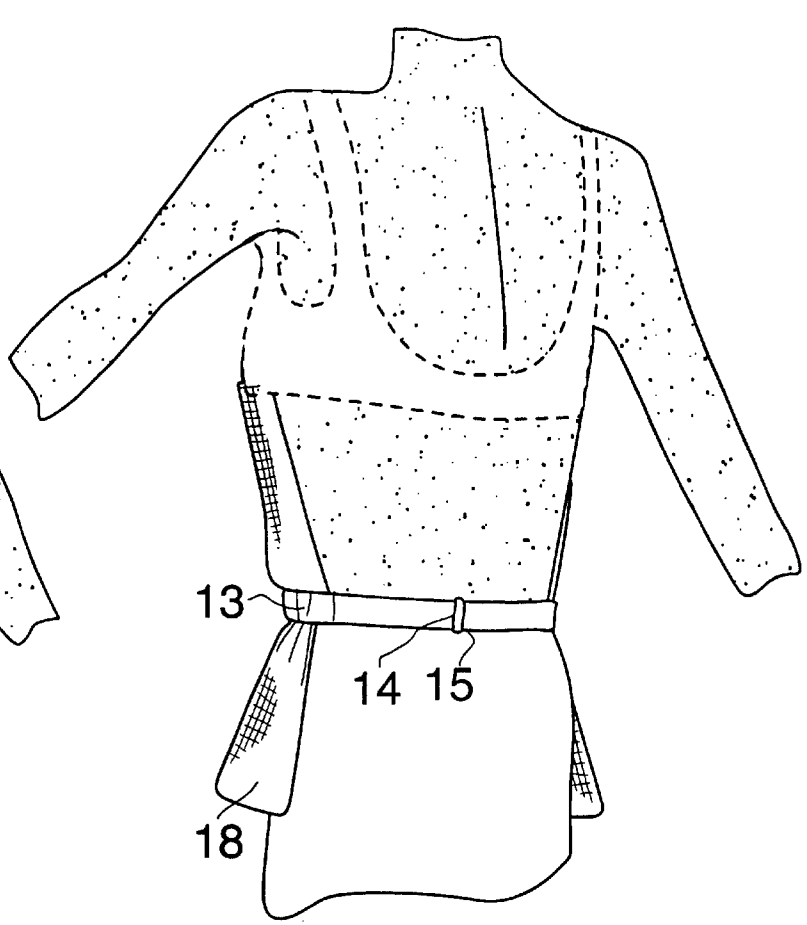
FIG. 4 is a rear view of the garment with scarf detached.
Figure 6:
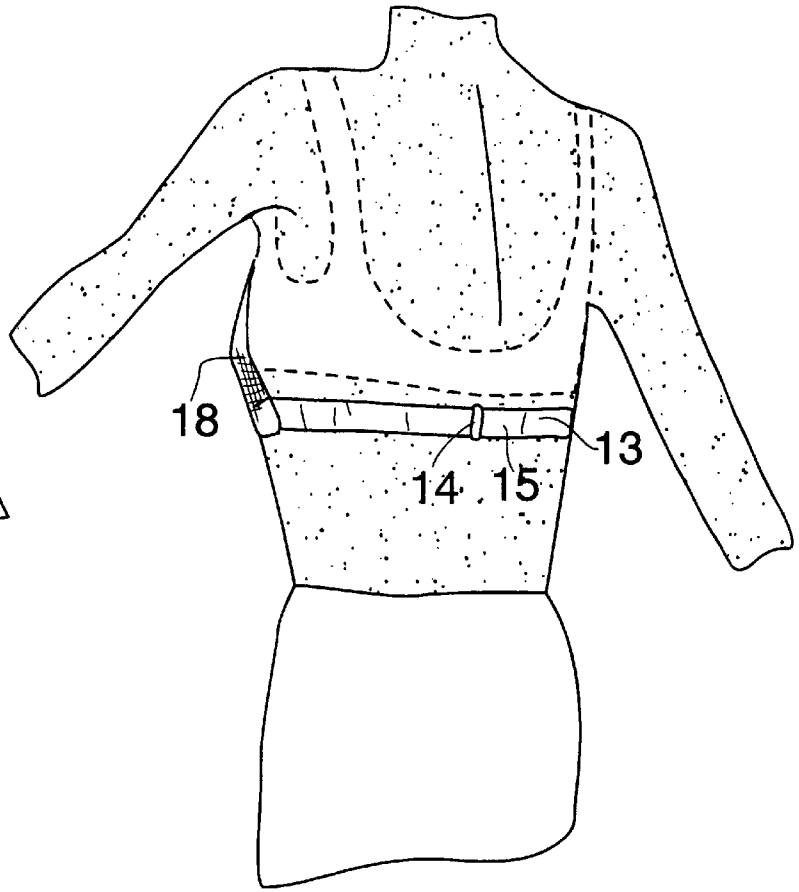
FIG. 6 is a rear view of the embodiment shown in FIG. 5 with the optional scarf detached, and worn by a person.

In FIGS. 2,4 and 6, a ¾ inch elastic band 13 and a bra hook 14 connect to a stitched elastic loop 15 in order to fasten the garment around the torso of the wearer.

FIG. 5 illustrates an alternative embodiment of the present invention comprised solely of an upper frontal portion piece 10. Thread 19 is used to make a ¾ inch channel at the base of the frontal portion piece 10.

Figure 8:
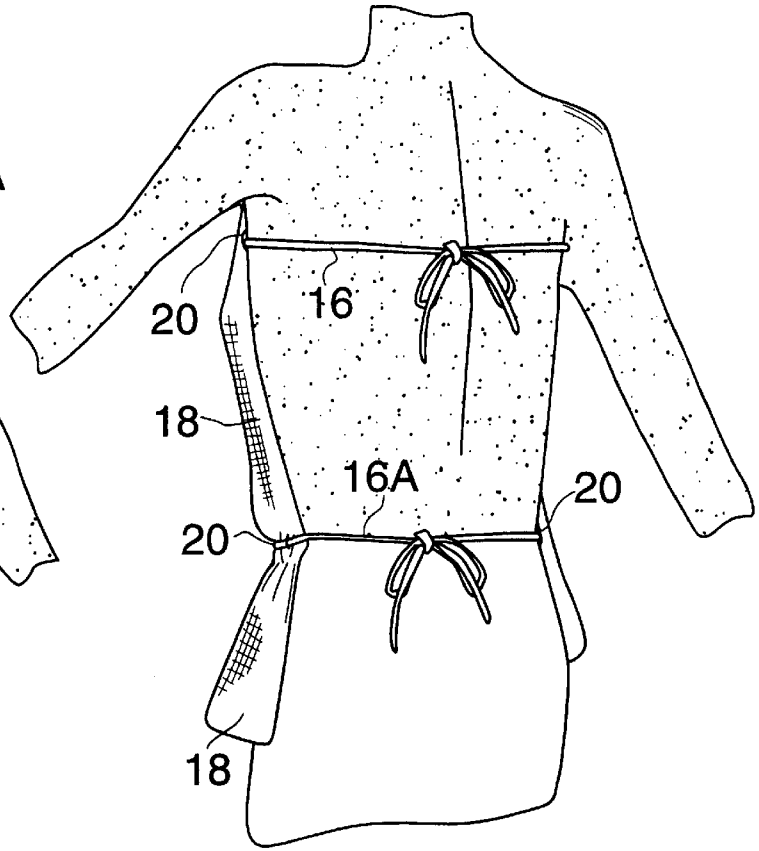
FIG. 8 is a rear view of the embodiment shown in FIG. 7 with the optional scarf detached, and worn by a person.

FIGS. 7 and 8 illustrate an alternative embodiment of the present invention in which two channels, upper 12*a* and lower 12 are created with thread 19. The channels serve to house the fastening means, which are comprised of a cord made of fabric or other material. Tacking 20 with thread 19 will attach the two cord ties 16, 16*a* to the channels 12*a*, 12 respectively to prevent slippage of the fabric. As illustrated in FIG. 8, a cord tie 16 fastens the upper portion of the garment and a second cord tie 16*a* fastens the lower portion of the garment. As illustrated in FIG. 7, only one female snap 17*a* is necessary for attachment of the optional scarf 10*a*. The female snap 17*a* may be attached to either side of the top of the frontal portion piece 10.

It is to be understood that various types of fastening elements, channel sizes, and band sizes, alone or in combination, can be used in lieu of the means previously described and still be within the scope of the invention.

Figure 9:
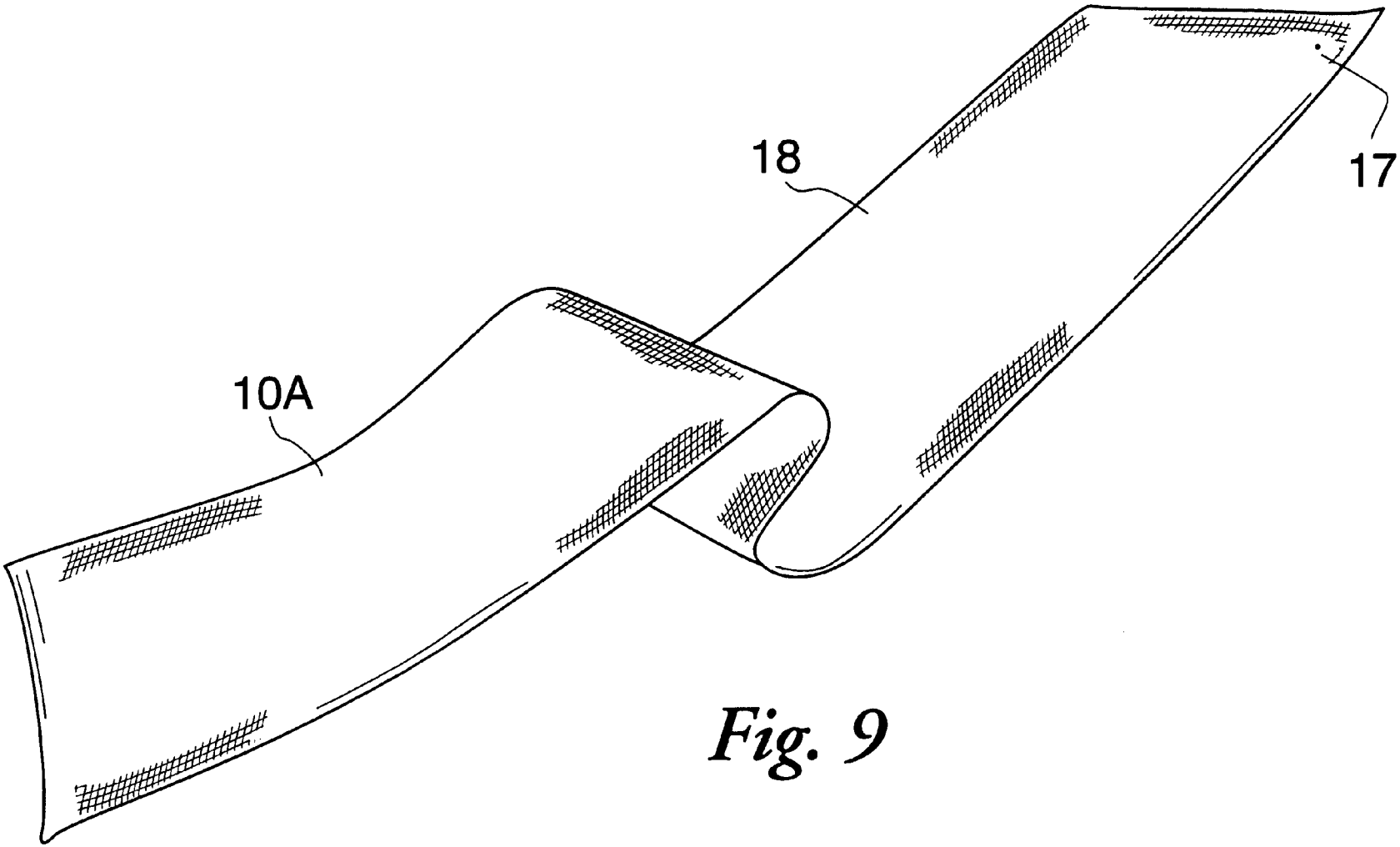
FIG. 9 is a front perspective view of the optional scarf that can be attached to all embodiments of the garment.

FIG. 9 illustrates the optional scarf attachment 10*a*. The male snap portion 17 is located on the corner of the scarf 10*a*. As illustrated in FIG. 9, the scarf attachment 10*a* will be comprised of a single piece of fabric.

In FIGS. 1–9, the edging 18 of all of the fabric is marrowed with thread.

While specific embodiments of the invention have been shown and described in detail to illustrate the application of the principles of the invention, it will be understood that the invention may be embodied otherwise without departing from such principles.

What is claimed is:

1. An outer garment comprised of:

a first piece of material for covering a frontal upper torso of a wearer including:

a first fastening means connected to a first edge of said first piece of material, said first fastening means for detachably engaging at least one shoulder strap of an undergarment to support said first edge uppermost on the wearer's body forming a neckline of the garment;

a second fastening means connected to said first piece of material, said second fastening means including a first part and a second part, said first part being connected to a second edge of said first piece of material, said second part being connected to a third edge of said first piece of material, said second and third edges being substantially opposite each other and extending downwards from the first edge, said first and second parts being connected to respective second and third edges at locations spaced below said first edge so that said first and second parts are connectable to each other extending completely around the torso of a wearer below the wearer's arms.

2. An outer garment as described in claim 1, wherein:

said first piece of material is comprised of fabric.

3. An outer garment as described in claim 1, wherein:

said first fastening means is comprised of at least one male snap portion and at least one female snap portion at spaced apart locations on a back of said first edge and engageable by wrapping said at least one male snap portion around a respective shoulder strap.

4. An outer garment as described in claim 1, wherein:

said first part of said second fastening means is comprised of an elastic band attached to a hook;

said second part of said fastening means is comprised of a stitched elastic loop;

said first part may be engaged to or detached from said second part.

5. An outer garment as described in claim 1, wherein:

said undergarment is a brassiere.

6. An outer garment as described in claim 1, wherein:

a second piece of material forms an elongate scarf which includes a third fastening means connectable to said first fastening means of said first piece of material.

7. An outer garment as described in claim 6, wherein:

said second piece of material is comprised of fabric.

8. An outer garment as described in claim 3, wherein:

a second piece of material forms an elongate scarf which includes a third fastening means connectable to said first fastening means of said first piece of material;

said third fastening means of said second piece of material is comprised of a male snap portion which corresponds to said female snap portion on said first edge of said piece of material,

9. An outer garment as described in claim 1, wherein:

said first piece of material includes a channel to house said second fastening means.

10. An outer garment as described in claim 1, wherein:

said second fastening means are comprised of a first cord and a second cord, each made of a material.

11. An outer garment as described in claim 1, wherein:

said garment is comprised of paper.

12. A sleeveless, backless, top for covering at least an upper frontal portion of a wearer's torso comprising a sheet of fabric having upper and lower transverse edge portions joined on a respective left side and a right side by respective opposite vertical side edge portions; releasable fastening means extending from locations of respective opposite side edge portions spaced below the upper edge portion for completely encircling a wearers torso below a wearer's arms for securing the sheet to the wearer extending across a frontal portion of the torso; and, further releasable, interengageable fastening means located adjacent the left side and the right side of a back of the upper edge portion for fastening the upper edge portion to respective shoulder straps of a brassiere by wrapping therearound from a front so that the shoulder straps provide sole support retaining an upper part of the sheet extending upwards from the releasable fastening means covering the brassiere and at least an upper portion of a front of the torso of the wearer with the upper edge portion forming a neckline so as to simulate a blouse to an observer when worn under a jacket, the further fastening means including respective series of spaced male and female fasteners which extend along a back side of the neckline selectively engageable to alter a drop of the neckline.

13. A sleeveless, backless, top according to claim 12 further including a scarf comprising an elongate strip of fabric, one longitudinal end of the scarf being provided with releasable fastening means releasably engaged with a selected fastener on the upper edge portion thereby retaining the scarf attached thereto for extending over a shoulder of the wearer.

* * * * *